US011022917B2

(12) United States Patent
Saito et al.

(10) Patent No.: US 11,022,917 B2
(45) Date of Patent: Jun. 1, 2021

(54) IMAGE HEATING APPARATUS

(71) Applicant: CANON KABUSHIKI KAISHA, Tokyo (JP)

(72) Inventors: Tohru Saito, Mishima (JP); Hideaki Yonekubo, Yokohama (JP); Keisuke Mochizuki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/717,884

(22) Filed: Dec. 17, 2019

(65) Prior Publication Data

US 2020/0209792 A1 Jul. 2, 2020

(30) Foreign Application Priority Data

Dec. 27, 2018 (JP) ..... JP2018-245426

(51) Int. Cl.
*G03G 15/20* (2006.01)

(52) U.S. Cl.
CPC ..... *G03G 15/2025* (2013.01); *G03G 15/2021* (2013.01); *G03G 15/2028* (2013.01); *G03G 15/2053* (2013.01)

(58) Field of Classification Search
CPC ..... G03G 15/2025; G03G 15/2021; G03G 15/2028; G03G 15/2053
See application file for complete search history.

(56) References Cited

U.S. PATENT DOCUMENTS

| | | | | |
|---|---|---|---|---|
| 8,831,495 | B2 * | 9/2014 | Kim | G03G 15/2025 399/329 |
| 9,110,413 | B2 * | 8/2015 | Ueda | G03G 15/206 |
| 2009/0041515 | A1 * | 2/2009 | Kim | G03G 15/2025 399/324 |
| 2015/0037078 | A1 * | 2/2015 | Ohta | G03G 15/2053 399/329 |
| 2016/0132003 | A1 * | 5/2016 | Koda | G03G 15/2053 399/329 |
| 2016/0179043 | A1 * | 6/2016 | Kawaguchi | G03G 15/2017 399/329 |
| 2016/0327893 | A1 * | 11/2016 | Kim | G03G 15/2053 |

(Continued)

FOREIGN PATENT DOCUMENTS

| | | | |
|---|---|---|---|
| JP | H0444075 | A | 2/1992 |
| JP | 5882956 | B2 | 3/2016 |

*Primary Examiner* — Carla J Therrien
(74) *Attorney, Agent, or Firm* — Canon U.S.A., Inc. IP Division

(57) ABSTRACT

An image heating apparatus includes an endless film, a pressing member forming a nip portion together with the film, and a film holding member provided at a longitudinal end portion of the film. The film holding member includes a movable member including a restriction surface configured to restrict a longitudinal movement of the film and a guide surface configured to guide a rotation of the film, the guide surface including a lubricant application unit. The film holding member further includes a biased member supporting the movable member and including a force reception portion, and is configured to cause the movable member to move upstream in a conveyance direction of the recording material at the nip portion relative to the biased member and cause the lubricant application unit to abut against an inner peripheral surface of the fixing film, when the movable member moves longitudinally.

10 Claims, 7 Drawing Sheets

(56) References Cited

U.S. PATENT DOCUMENTS

| | | | | |
|---|---|---|---|---|
| 2018/0259888 | A1* | 9/2018 | Mitsui | G03G 15/2025 |
| 2018/0373187 | A1* | 12/2018 | Ikebuchi | G03G 15/2025 |
| 2019/0346797 | A1* | 11/2019 | Okajima | G03G 15/2064 |

* cited by examiner

IMAGE HEATING APPARATUS

BACKGROUND OF THE DISCLOSURE

Field of the Disclosure

The present disclosure relates to an image heating apparatus as a fixing unit for heating and fixing an unfixed toner image formed and borne on a recording material in an image forming apparatus such as a copying machine and a printer using an electrophotographic method or an electrostatic recording method.

Description of the Related Art

Conventionally, the heat roller method has been widely used in, for example, image heating apparatuses. The heat roller method heats a recording material as a heating target material while sandwiching and conveying it at a nip portion formed by a heat roller as a heating member kept at a predetermined temperature and a pressing roller as a pressing member in pressure contact with the heat roller.

Further, besides the heat roller method, an image heating apparatus based on the film heating method has been contrived (for example, Japanese Patent Application Laid-Open No. 4-44075). The image heating apparatus based on the film heating method includes a heater that serves as a heat source, a support member (a stay) for the heater, an endless thermally-resistant film (hereinafter referred to as a film) that faces and contacts the heater, and a pressing roller that brings a recording material into close contact with the heater via the film. The image heating apparatus based on the film heating method heats and fixes an unfixed image formed and borne on a surface of the recording material onto the surface of the recording material by applying heat of the heater to the recording material via the film at the nip portion formed by the heater and the pressing roller.

A heater having a low thermal capacity can be used as the heater for such an image heating apparatus based on the film heating method. Therefore, this type of image heating apparatus can achieve power saving and a reduction in a waiting time (a reduction in a first printout time) compared to the apparatuses based on the heat roller method or the like.

Further, for the image heating apparatus, consideration has been given to preventing a reduction in durability of the fixing film to prevent occurrence of a defect (Japanese Patent No. 5882956). In this configuration, the image heating apparatus is configured in such a manner that a holding member holding the fixing film at an end portion is provided movably in an upstream direction of a recording material conveyance direction, and the holding member moves upstream to push an inner peripheral surface of the fixing film in the upstream direction. In this manner, there has been discussed the image heating apparatus configured to correct the orientation of the fixing film to reduce a force for displacement, thereby allowing the fixing film to operate in the corrected orientation and under the reduced force for displacement and thus being able to improve the reduction in the durability of the fixing film.

However, according to the image heating apparatus configured to allow the holding member to move in the upstream direction of the recording material conveyance direction, the holding member pushes the inner peripheral surface of the fixing film to change the orientation of the fixing film. This results in an increase in a pressure with which the holding member pushes the fixing film at a portion where the holding member pushes the inner peripheral surface of the fixing film, thereby leading to an increase in sliding friction between the holding member and the fixing film and thus an increase in wear of the inner peripheral surface of the fixing film at the abutment portion.

Especially, when a lubricant applied on the nip portion of the image heating apparatus is deteriorated due to endurance or the amount of the lubricant reduces in the course of endurance due to volatilization, the lubricant interposed at the abutment portion between the inner peripheral surface of the fixing film and the holding member also reduces due to the endurance, so that the wear in the course of the endurance increases.

Furthermore, the image heating apparatus may be continuously used even after having ended its nominal lifetime, and, in this case, the increase in the wear leads to a reduction in the thickness of a base layer of the fixing film and thus a reduction in the strength of the fixing film at the abutment portion, thereby raising a risk of a breakage of the fixing film such as a rupture and buckling.

Increasing the thickness of the base layer of the fixing film in an initial state in advance may be one conceivable method for preventing the reduction in the thickness of the base layer of the fixing film and thus the reduction in the strength due to scraped inner peripheral surface of the base layer of the fixing film, but brings in such a problem that a time required to start up the image heating apparatus is lengthened because of an increase in the thermal capacity of the base layer.

Also, another possible risk is impairment of the slidability at the nip portion due to contamination of the lubricant in the fixing film or at the nip portion with shaved powder, followed by occurrence of a slip of the fixing film, an image streak, or the like.

SUMMARY OF THE DISCLOSURE

In consideration of these circumstances, the present disclosure provides, as an image heating apparatus configured to restrict a displacement of a fixing member, an image heating apparatus that reduces wear on an inner peripheral surface of the fixing member and thus reduce a defect such as a slip and an image streak due to shaved powder.

According to an aspect of the present disclosure, an image heating apparatus is configured to allow a recording material with an image formed thereon to be heated while being conveyed at a nip portion, thereby allowing the image to be fixed onto the recording material. The image heating apparatus includes an endless film, a pressing member forming the nip portion together with the film by contacting an outer peripheral surface of the film, and a film holding member provided at a longitudinal end portion of the film. The film holding member includes a movable member. The movable member includes a restriction surface configured to restrict a longitudinal movement of the film by contacting the film when the film moves longitudinally and a guide surface facing an inner peripheral surface of the film and configured to guide a rotation of the film. In addition, the film holding member further includes a biased member supporting the movable member and including a force reception portion configured to receive a biasing force toward the pressing member. The guide surface of the movable member includes a lubricant application unit. The film holding member is configured in such a manner that a longitudinal movement of the movable member causes the movable member to move upstream in a conveyance direction of the recording material at the nip portion relative to the biased member and causes the lubricant application unit to abut against the inner peripheral surface of the fixing film.

Further features and aspects of the present disclosure will become apparent from the following description of example embodiments, features and aspects thereof with reference to the attached drawings.

DESCRIPTION OF THE EMBODIMENTS

In the following description, how the present disclosure can be implemented will be described in detail based on an example embodiment thereof with reference to the drawings. However, dimensions, materials, shapes, a relative layout, and the like of components that will be described in the following example embodiment shall be changed as appropriate according to a configuration of an apparatus to which the present disclosure is applied and various kinds of conditions. In other words, they are not intended to limit the scope of the present disclosure to the following example embodiment.

(1) Example Image Forming Apparatus

Figure 1:
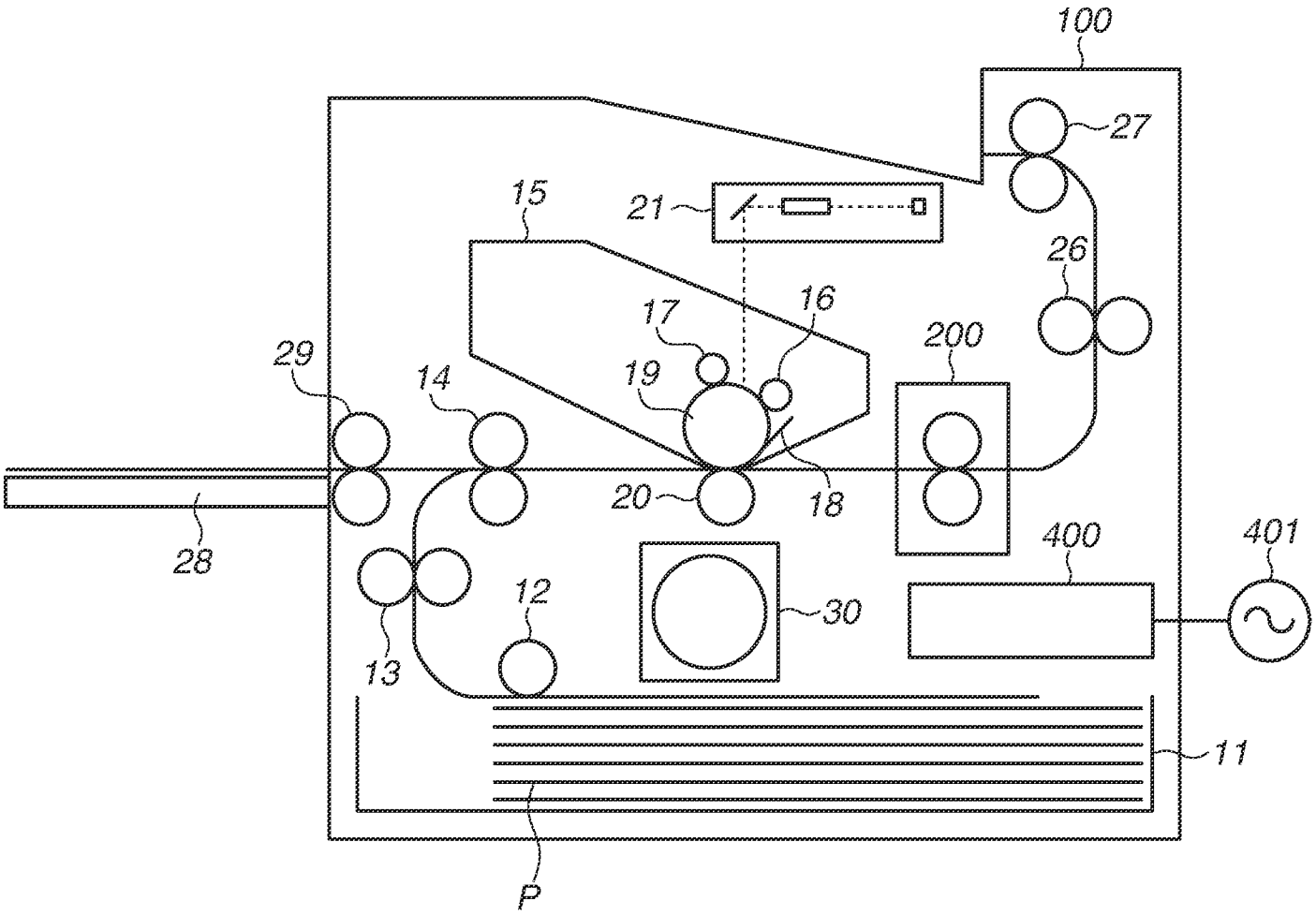
FIG. 1 is a cross-sectional view of an image forming apparatus according to a first example embodiment.

First of all, a configuration of an image forming apparatus 100 according to a first example embodiment will be described with reference to FIG. 1. FIG. 1 is a schematic cross-sectional view of the image forming apparatus 100 according to the present example embodiment. The image forming apparatus 100 is a laser beam printer that forms an image onto a recording material P with use of the electrophotographic method.

The image forming apparatus 100 includes a cartridge 15 including a photosensitive drum 19 as an image bearing member, a charging roller 16 as a charging member, a development roller 17 as a development member, and a cleaning blade 18 as a cleaning member. In the present example embodiment, a development unit including the photosensitive drum 19, the charging roller 16, and the development roller 17, and a cleaning unit including the cleaning blade 18 are configured in a manner detachably attachable to an apparatus main body of the image forming apparatus 100 as the process cartridge 15.

The photosensitive drum 19 is rotationally driven at a predetermined circumferential speed (a process speed) in a counterclockwise direction. The charging roller 16 evenly charges a circumferential surface of the photosensitive drum 19 in such a manner that this surface has a predetermined polarity and potential (primary charging). The photosensitive drum 19 charged by the primary charging is subjected to scan and exposure (irradiation) of the charged surface thereof with laser light emitted from a laser scanner 21. The laser scanner 21 as an image exposure unit outputs laser light on-off modulated in correspondence with a chronological electric digital pixel signal of target image information input from a not-illustrated external apparatus such as an image scanner and a computer. As a result, an electrostatic latent image corresponding to the target image information is formed on the photosensitive drum 19, with electric charges removed from an exposed bright portion on the circumferential surface of the photosensitive drum 19 by this scan and exposure.

The development roller 17 bears a developer (toner) on a surface thereof and supplies the developer onto the circumferential surface of the photosensitive drum 19, and sequentially develops the electrostatic latent image formed on the circumferential surface of the photosensitive drum 19 as a toner image. In the case of the laser printer, a generally employed method is a reversal development method, which develops the electrostatic latent image by attaching the toner to the exposed bright portion of the electrostatic latent image.

The recording material P is stacked and contained in a sheet feeding cassette 11 configured in a manner detachably attachable to the image forming apparatus 100. The image forming apparatus 100 includes a sheet feeding roller 12, which separates and feeds the recording material P one by one, a conveyance roller 13, which conveys the recording material P, a registration roller 14, which adjusts a timing of feeding the recording material P, and the like. The sheet feeding roller 12 is driven based on a sheet feeding start signal, by which the recording material P in the sheet feeding cassette 11 is separated and fed one by one, and is introduced to a transfer portion between the photosensitive drum 19 and a transfer roller 20 (a transfer member) by the registration roller 14 via the conveyance roller 13 at a predetermined timing. More specifically, the conveyance of the recording material P is controlled by the registration roller 14 so as to satisfy such a timing that, when a leading edge portion of the toner image on the photosensitive drum 19 reaches the transfer portion, a leading edge portion of the recording material P also reaches the transfer portion just at the same time. The image forming apparatus 100 may be configured in such a manner that the recording material P placed on a manual feeding tray 28 is separated and fed one by one by a sheet feeding roller 29, and is introduced to the transfer portion between the photosensitive drum 19 and the transfer roller 20 by the registration roller 14 at the predetermined timing.

The recording material P introduced to the transfer portion is conveyed while being sandwiched through this transfer portion, and a transfer voltage (a transfer bias) controlled in a predetermined manner is applied from a not-illustrated transfer bias application power source to the transfer roller 20 during this time. Generally, the transfer roller 20 is embodied by an elastic sponge roller prepared by forming, on a core metal such as Fe, a semi-conductive sponge elastic layer adjusted so as to have resistance of approximately $1\times10^6$ to $1\times10^{10}\Omega$ with use of carbon, an ionically conductive filler, or the like. In the present example embodiment, the image forming apparatus 100 uses an ionically conductive transfer roller prepared by causing a nitrile butadiene rubber (NBR) and a surfactant or the like to react with each other externally around the core metal concentrically and integrally, and shaping a conductive elastic layer into a roller-like form and providing it. The transfer roller used has a resistance value in a range of $1\times10^8$ to $5\times10^8\Omega$.

The transfer bias opposite in polarity from the toner is applied to the transfer roller 20, by which the toner image formed on the circumferential surface of the photosensitive drum 19 is electrostatically transferred onto a surface of the recording material P at the transfer portion. The recording material P with the toner image transferred thereon is conveyed and introduced from the transfer portion to an image heating apparatus 200, and is subjected to fixing processing for heating and pressing the toner image. Then, the recording material P with the toner image fixed thereon by the image heating apparatus 200 is discharged onto a sheet discharge tray on the image forming apparatus 100 by passing through a conveyance roller 26, which conveys the recording material P. and a sheet discharge roller 27, which discharges the recording material P. Then, the image formation is completed.

On the other hand, after the toner image is transferred onto the recording material P, the circumferential surface of the photosensitive drum 19 is used for the next image formation by being treated by a removal of transfer residual toner, paper dust, and the like with use of the cleaning blade 18 and being processed by the primary charging again.

(2) Example Image Heating Apparatus

Figure 2:
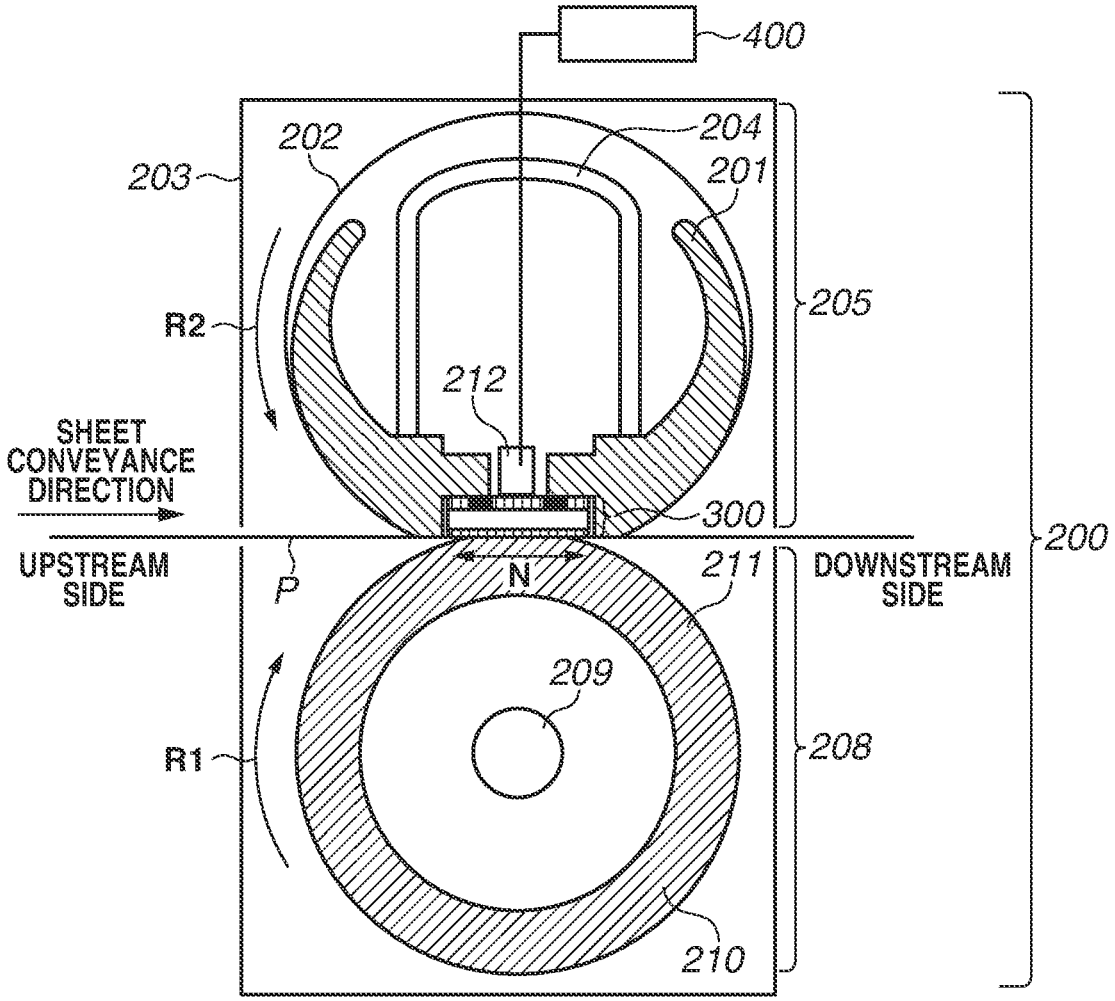
FIG. 2 is a cross-sectional view of an image heating apparatus that is an example according to the first example embodiment.
Figure 3:
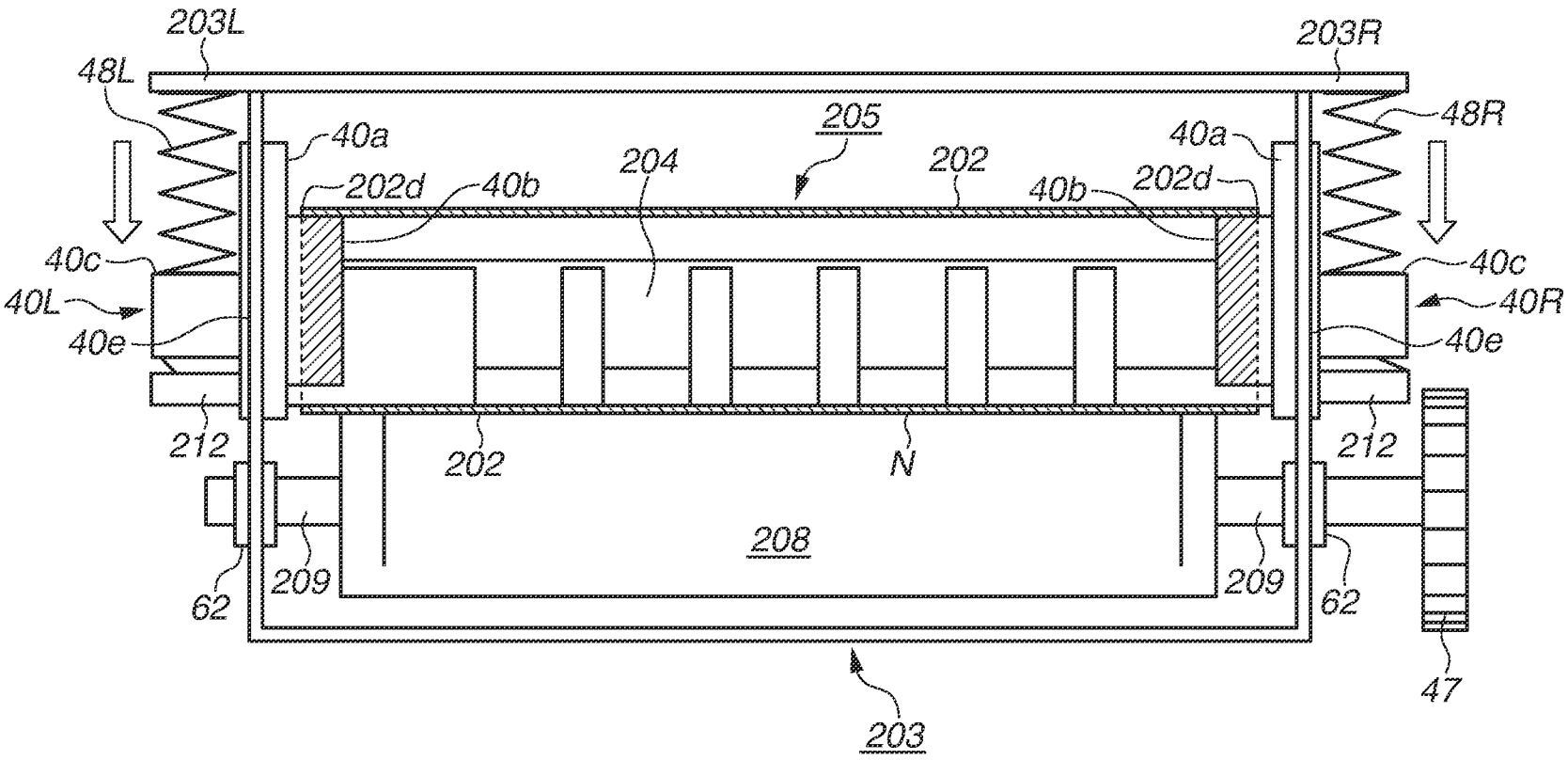
FIG. 3 is a cross-sectional view of the image heating apparatus according to the first example embodiment.
Figure 4:
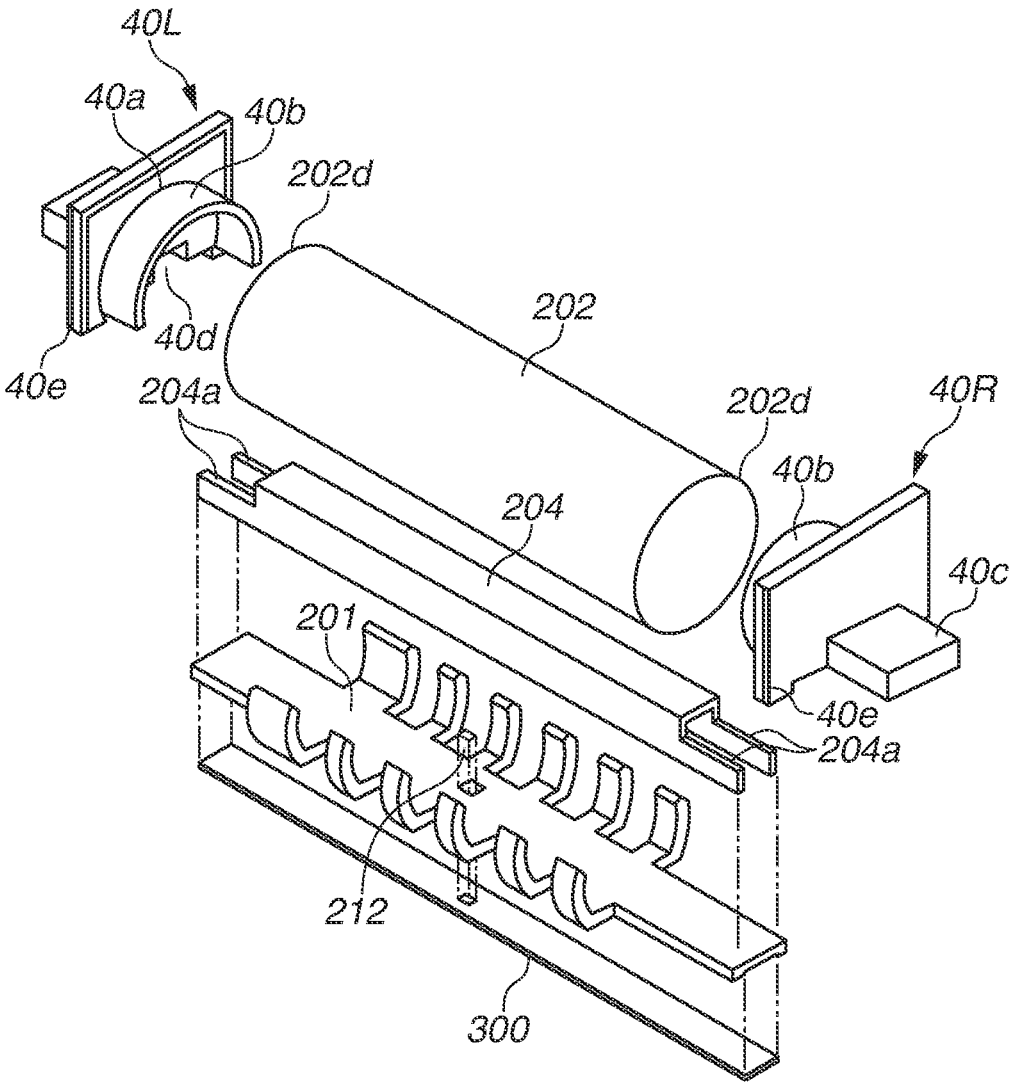
FIG. 4 is an exploded perspective view of the image heating apparatus according to the first example embodiment.

Next, the image heating apparatus 200 based on the film heating method according to the present example embodiment will be described. FIG. 2 is a schematic lateral cross-sectional view of the image heating apparatus 200 according to the present example embodiment, and FIG. 3 is a schematic longitudinal cross-sectional view of the image heating apparatus 200 according to the present example embodiment. Further, FIG. 4 is an exploded perspective view illustrating components of the image heating apparatus 200 according to the present example embodiment. The image heating apparatus 200 includes a film unit (a belt unit) 205, a pressing roller (a rotational member) 208 as a pressing member, and a casing 203, which houses them.

The pressing roller 208 is rotatably arranged while one end and the other end of a core metal 209 thereof are borne on side plates on one end side and the other end side of the casing 203 via bearing members 62, respectively. A driving gear 47 is provided on the other end side of the core metal 209, and the pressing roller 208 is configured to be drivable in a direction indicated by an arrow R1 in FIG. 2 as a driving rotational member in reaction to transmission of a driving force of a motor 30 controlled by a not-illustrated control unit (an engine controller) to the driving gear 47. The pressing roller 208 includes the core metal 209, an elastic body layer 210, and a front layer 211, which is an outermost layer. In the present example embodiment, an aluminum core metal, a silicon rubber, and a perfluoroalkoxy (PFA) tube approximately 50 μm in thickness are used as the core metal 209, the elastic body layer 210, and the front layer 211, respectively. The outer diameter of the pressing roller 208 is set to 25 mm, and the thickness of the elastic body layer 210 is set to approximately 3 mm.

The film unit 205 includes a heater (a heating member) 300, a support member 201, a film 202, and a stay 204. The heater 300, the support member (a guide member) 201, which holds the heater 300 and also guides a rotation of the film 202, and the stay 204, which supports the support member 201, are arranged inside the film 202 as an internal assembly.

In particular, a ceramic heater is used as the heater 300, and the heater 300 is arranged in a state laid face up in such a manner that a surface on an opposite side from a front surface side of a substrate with a heating resistor and an insulative protection layer formed thereon faces the film 202. The heater 300 is arranged in such a manner that the temperature thereof is detectable by a thermometer element (a thermistor) 212. In the present example embodiment, an externally abuttable thermistor separated from the heater 300 is used as the thermometer element 212.

The support member 201 is a thermally resistant and stiff member having a holding function of holding the heater 300 along a longitudinal direction on a bottom surface and a film guide function of guiding the rotation of the film 202. The support member 201 can be prepared by using, for example, highly thermally resistant resin such as polyimide, polyamide-imide, polyetheretherketone (PEEK), polyphenylene sulfide (PPS), and liquid crystal polymer, or a composite material of these kinds of resin and ceramics, metal, glass, and/or the like. In the present example embodiment, the liquid crystal polymer is used. The support member 201 is supported by the stay 204, which is stiffer. In the present example embodiment, the stay 204 made of metal is used.

The film 202 is externally fitted to the support member 201 holding the heater 300 and functioning as the film guide member, and is configured in such a manner that an inner peripheral surface thereof can rotate around the support member 201 while contacting the heater 300. Desirably, the film thickness of the film 202 is set to a thickness of 450 μm or thinner and 20 μm or thicker to reduce a thermal capacity thereof and thus reduce a waiting time (a first printout time). Further, examples usable as the film 202 include a single-layered film such as thermally resistant polytetrafluoroethylene (PTFE), PFA, and fluorinated ethylene propylene (FEP), or a multiple-layered film prepared by coating a film such as polyimide, polyamide-imide, PEEK, polyethersulfone (PES), and PPS with PTFE, PFA, FEP, or the like. In the present example embodiment, the image heating apparatus 200 uses a film prepared by coating an outer peripheral surface of a polyimide film 60 μm in film thickness with PFA. The thickness of the PFA coating layer is set to approximately 15 μm. The outer diameter of the film 202 is set to 24 mm. For the base layer of the film 202, the usable materials include not only the above-described resin materials but also a metallic material such as stainless steel (SUS). A thermally resistant rubber such as a silicon rubber may be formed between the base layer and the coating layer as an elastic layer to improve an image quality.

Then, all of the heater 300, the support member 201, and the stay 204 are members having lengths longer than the width (the length) of the film 202, and one end sides (left sides) and the other end sides (right sides) thereof protrude out of both ends of the film 202, respectively. The film unit 205 further includes flanges 40 (a film holding member), and outward protrusion portions 204*a* on the one end side and the other end side of the stay 204 are inserted in the flanges 40 on the one end side and the other end side, respectively. In other words, the flanges 40 are disposed at both longitudinal end portions of the film 202. Hereinafter, a "flange 40L", a "flange 40R", and "flanges 40" refer to the flange on the left side (the one end side), the flange on the right side (the other end side), and both the flanges on the left and right sides, respectively.

The flanges 40 are individually horizontally symmetrically-shaped mold product made of thermally resistant resin that are disposed on the both longitudinal end portions of the film 202. Each of the flanges 40 includes an insertion target portion 40*d*, in which the external protrusion portion 204*a* of the stay 204 is inserted, a groove portion 40*e*, which is fixed to a vertical edge portion of a slit provided on the side plate of the casing 203, and a force reception portion 40*c*. The flange 40 is brought into such a state that the groove portion 40*e* is engaged with the vertical edge portion of the slit provided on the side plate of the casing 203 with the outward protrusion portion 204*a* of the stay 204 inserted in the insertion target portion 40*d*. Due to this configuration, the flanges 40L and 40R are held vertically and slidably movable relative to the side plates, respectively. More specifically, the film unit 205, as a whole, is configured movably in directions toward and away from the pressing roller 208 along the vertical guide slits between the side plates.

On the other hand, pressing springs 48L and 48R included in the image heating apparatus 200 are in abutment with the force reception portions 40*c* of the flanges 40L and 40R, respectively. The pressing spring 48L and the pressing spring 48R are compressively mounted between a spring bearing portion 203L on the one end side of the casing 203 and the force reception portion 40*c* of the flange 40L, and between a spring bearing portion 203R on the other end side of the casing 203 and the force bearing portion 40*c* of the flange 40R, respectively. As a result, biasing forces are applied to the outward protrusion portions 204*a* and 204*a* on the one end side and the other end side of the stay 204 of the film unit 205 via the flanges 40L and 40R with the aid of compressive mounting reaction forces of the pressing springs 48L and 48R, respectively.

Due to this configuration, the support member 201 including the heater 300 and the pressing roller 208 are in pressure contact with each other with a predetermined pressing force while sandwiching the film 202 against the elasticity of the elastic body layer 210 of the pressing roller 208. In the image heating apparatus 200 according to the present example embodiment, the heater 300 functions as a nip portion formation member, and the support member 201 also functions as an abutting sliding member (a backup member) in contact with the inner peripheral surface of the film 202. In this way, a nip portion N having a predetermined width in a sheet conveyance direction is formed between the film 202 and the pressing roller 208.

In the image heating apparatus 200, when a print signal is input from an external input apparatus such as a personal computer (PC), the pressing roller 208 is rotationally driven in the direction indicated by the arrow R1 (the clockwise direction) by the motor 30 controlled by the control unit 400. On the film 202, a rotational force is transmitted from the pressing roller 208 to the film 202 due to a frictional force between the pressing roller 208 and the outer peripheral surface of the film 202 at the nip portion N, and the film 202 is rotationally driven as the inner peripheral surface of the film 202 is slidingly moved on the heater 300 at the nip portion N. In this manner, the film 202 is moved and rotated in a direction indicated by an arrow R2 (a counterclockwise direction) around the support member 201 at approximately the same speed as a movement speed of the circumferential surface of the pressing roller 208.

On the other hand, at the heater 300, the heater 300 (the heating resistor) is caused to generate heat by supply of power from the control unit 400 as a driving unit connected to an alternating-current power source (an outlet) 401 via a power supply electrode of the heater 300. The control unit 400 controls the power supply to the heater 300 using a not-illustrated triac provided to the control unit 400 based on information regarding the temperature of the heater 300 output from the thermistor 212, thereby controlling the temperature of the heater 300. More specifically, the heater 300 is kept at a constant temperature at the time of the fixing by being subjected to the control of the power supply thereto by the control unit 400 in such a manner that the temperature thereof is increased when the output from the thermistor 212 is an output according to a low temperature compared to a set temperature while the temperature of the heater 300 is reduced when the output from the thermistor 212 is an output according to a high temperature compared to the set temperature.

After the temperature of the heater 300 is raised to a predetermined temperature and the film 202 is brought into a state rotationally driven by the pressing roller 208, the recording material P with the toner image transferred thereon is conveyed from the transfer portion to the nip portion N formed by the heater 300 and the pressing roller 208 via the film 202. Then, the recording material P is sandwiched and conveyed through the nip portion N together with the film 202, by which the heat of the heater 300 is applied to the recording material P via the film 202 and the unfixed toner image on the recording material P is heated and pressed, thereby being fixed onto the recording material P. The recording material P conveyed through the nip portion N is separated from the film 202 and is further conveyed.

(3) Example Detailed Configuration of Flange

In the following description, a configuration of the flange 40 in the image heating apparatus 200 according to the first example embodiment will be described.

Figure 5B:
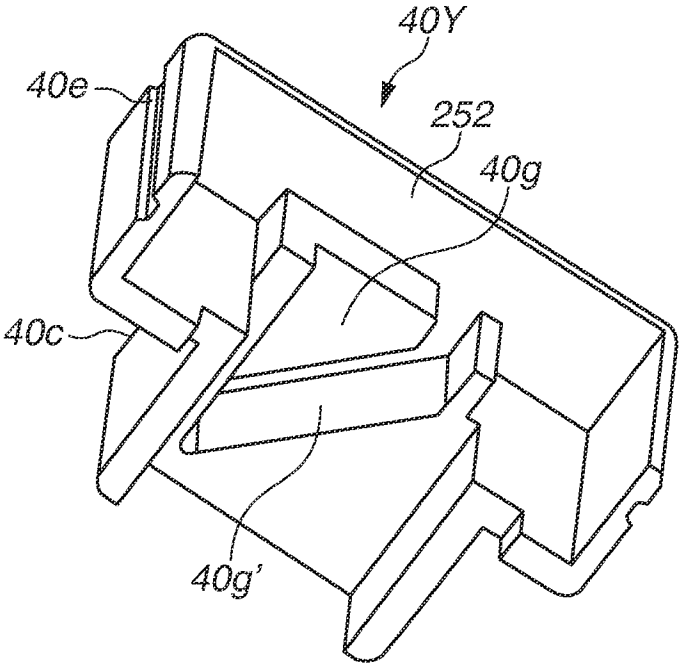
FIGS. 5A and 5B are perspective views of a movable member and a biased member forming a flange according to the first example embodiment, respectively.
Figure 5A:
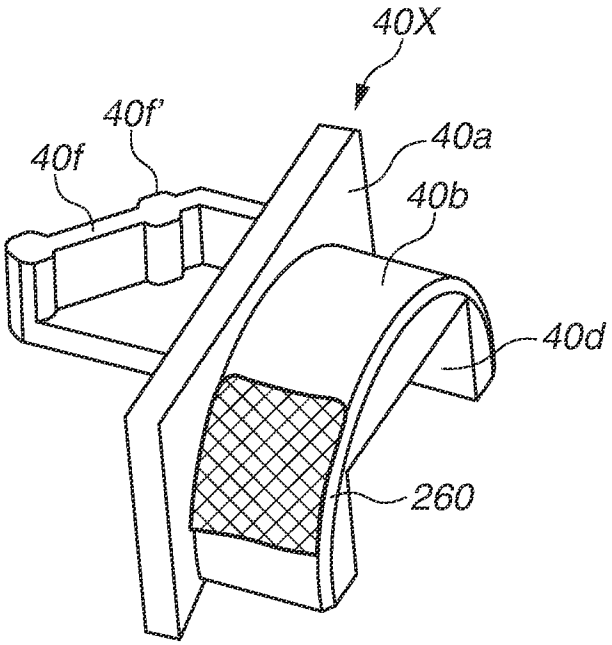

The flange 40 includes a movable member 40X, a biased member 40Y, and springs 253. FIG. 5A illustrates the movable member 40X, and FIG. 5B illustrates the biased member 40Y. At the flange 40, the movable member 40X is provided with a restriction surface 40*a*, a guide surface 40*b*, and the insertion target portion 40*d*, and the biased member 40Y is provided with the force reception portion 40*c* and the groove portion 40*e*. For the movable member 40X and the biased member 40Y forming the flange 40, resin containing glass fibers, such as PPS, liquid crystal polymer, polyethylene terephthalate (PET), and polyamide (PA) is used as a material that has high thermal resistance, small thermal conductivity, and excellent slidability, and PPS is used in the present example embodiment.

The groove portion 40*e* is engaged with the vertical edge portion of the slit provided on the side plate of the casing 203 with the outward protrusion portion 204*a* of the stay 204 inserted in the insertion target portion 40*d*. Thus, the flange 40 is slidably configured and the force reception portion 40*c* is biased by the pressing spring 48 (L or R). In this manner, the flange 40 supporting the stay 204 is pressed toward the pressing roller 208, resulting in the nip portion N formed between the pressing roller 208 and the flange 40.

Figure 6B:
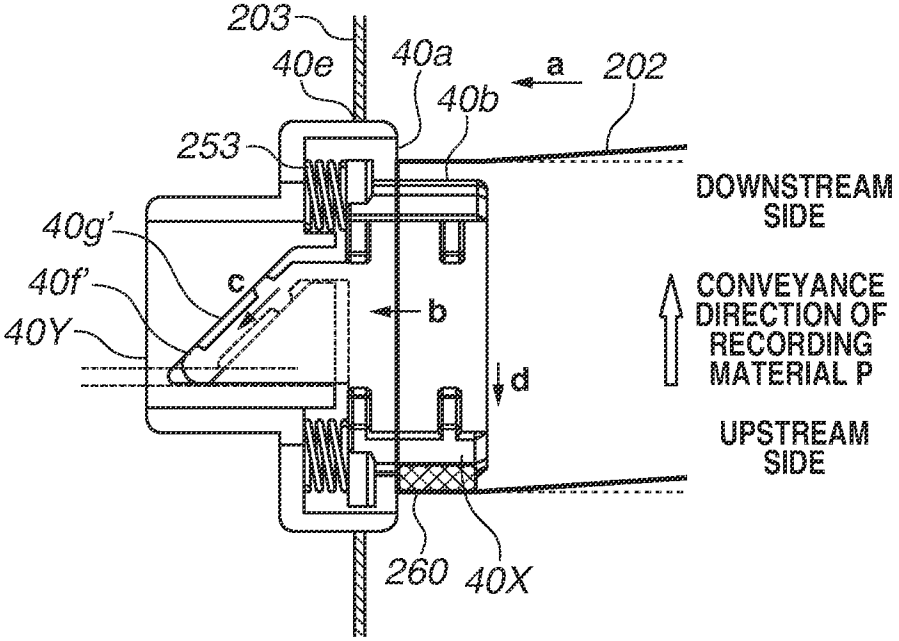
FIGS. 6A and 6B are cross-sectional views illustrating a vicinity of the flange in the image heating apparatus according to the first example embodiment.
Figure 6A:
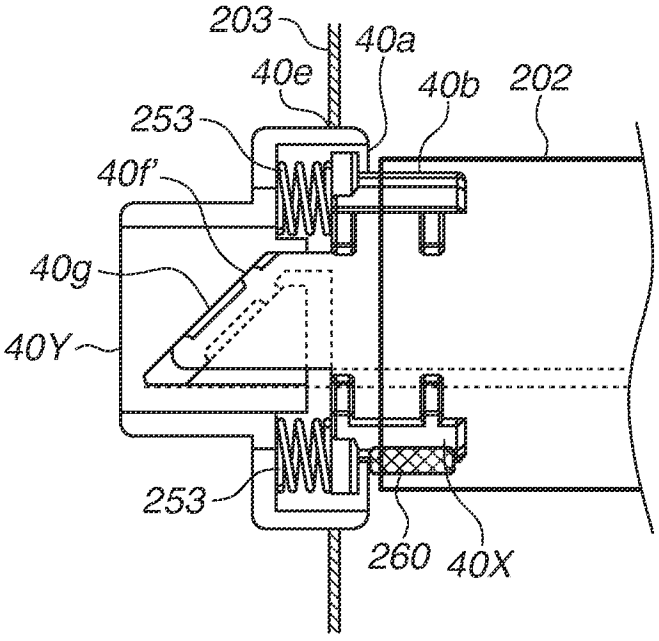

An operation of restricting a displacement of the fixing member according to the present example embodiment will be described. FIG. 6A illustrates a state in which the fixing film 202, which is the fixing member, is not displaced, and FIG. 6B illustrates a state in which the fixing film 202 is displaced.

The restriction surface 40*a* faces an end surface 202*d* at the longitudinal end portion of the film 202, and serves the role of restricting a movement (a displacement) when the film 202 moves longitudinally, so that the film 202 stays at a predetermined longitudinal position. In other words, the restriction surface 40*a* is configured in such a manner that, when the film 202 is displaced, the film end surface 202*d* abuts against the restriction surface 40*a* of the flange 40, whereby displacement of the film 202 is restricted.

The guide surface 40*b* guides the inner peripheral surface of the rotating film 202 in a region at the longitudinal end portion of the film 202. More specifically, the guide surface 40*b* serves the role of causing the film 202 to draw a desired rotational locus by supporting the inner peripheral surface at the longitudinal end portion of the film 202 from inside. When the inner peripheral surface at the end portion of the rotating film 202 and the guide surface 40*b* of the flange 40 contact each other and slidingly move on each other, the heat necessary in fixing the toner is deprived by the flange 40. Therefore, the guide surface 40*b* of the flange 40 is positioned in a region longitudinally outside a conveyance region Wmax of the recording material P having a maximum size on which the toner is fixable by the image heating apparatus 200.

Further, in the present example embodiment, a lubricant application unit 260 is provided on the guide surface 40*b* at a portion thereof in abutment with the fixing film 202. Examples usable as the lubricant application unit 260 include a lubricant supply member made from, for example, porous fluororesin, a Nomex felt, a Nomex braid, a Nomex fiber bundle, a glass fiber bundle, a carbon fiber bundle, a carbon felt, an aramid fiber bundle, or a polyimide foam. Further, grease prepared by thickening perfluoro polyether base oil with fluororesin, or a thermally resistant lubricant such as silicon oil including dimethyl silicone can be used as a lubricant permeating or penetrating into the lubricant supply member.

The movable member 40X is disposed adjacent to the biased member 40Y via the springs 253 while supporting the stay 204 with the outward protrusion portion 204*a* of the stay 204 inserted in the insertion target portion 40*d*. At the flange 40, the biased member 40Y is disposed longitudinally outside the movable member 40X without the springs 253 compressed in a state not subjected to application of an external force. The movable member 40X includes a protrusion portion 40*f* protruding longitudinally outward, and includes a sliding portion 40*f* longitudinally outside the protrusion portion 40*f*. The sliding portion 40*f* extends further longitudinally outward as stretching from a downstream side toward an upstream side in the movement direction of the recording material P at the nip portion N. On the other hand, the biased member 40Y includes a recessed portion 40*g* for accommodating the protrusion portion 40*f*, and includes an inclined surface 40*g*' longitudinally outside the recessed portion 40*g*. The inclined surface 40*g*' extends further longitudinally outward as stretching from the downstream side toward the upstream side in the movement direction of the recording material P at the nip portion N.

In this manner, when the film 202 is displaced and causes the restriction surface 40*a* to move to the longitudinal end portion, the springs 253 are compressed. As a result, the sliding portion 40*f* of the movable member 40X contacts the inclined surface 40*g*' of the biased member 40Y, and the movable member 40X moves upstream in the recording material conveyance direction at the nip portion N along the inclined surface 40*g*'. When the movable member 40X moves upstream and pushes up the end portion of the fixing film 202 upstream in the conveyance direction of the recording material P, the orientation of the fixing film 202 is changed and contributes to reducing the displacement of the fixing film 202. In the present example embodiment, as illustrated in FIG. 6B, the fixing film 202 is displaced and the movable member 40X moves upstream in the conveyance direction of the recording material P, by which the lubricant application unit 260 abuts against the inner peripheral surface of the fixing film 202. As a result, not only the lubricant is applied onto the inner peripheral surface of the fixing film 202 but also shaved powder generated due to sliding friction between the fixing film 202 and the guide surface 40*b* is collected by the lubricant application unit 260. In this manner, the movable member 40X abuts against the inner peripheral surface of the fixing film 202 and generates the sliding friction therebetween when the movable member 40X pushes up the end portion of the fixing film 202 upstream. As a result, the lubricant application unit 260 abuts against only a part of the inner peripheral surface of the fixing film 202 without abutting against the entire circumference of the inner peripheral surface of the fixing film 202, thereby reducing the sliding resistance between the lubricant application unit 260 and the fixing film 202.

According to the present example embodiment, providing the lubricant application unit 260 at the flange 40 of the fixing member can reduce the wear on the inner peripheral surface of the fixing member with a simple structure and also can reduce a defect such as an image streak due to the shaved powder, thus being able to prolong the product lifetime of the image heating apparatus 200.

Figure 7:
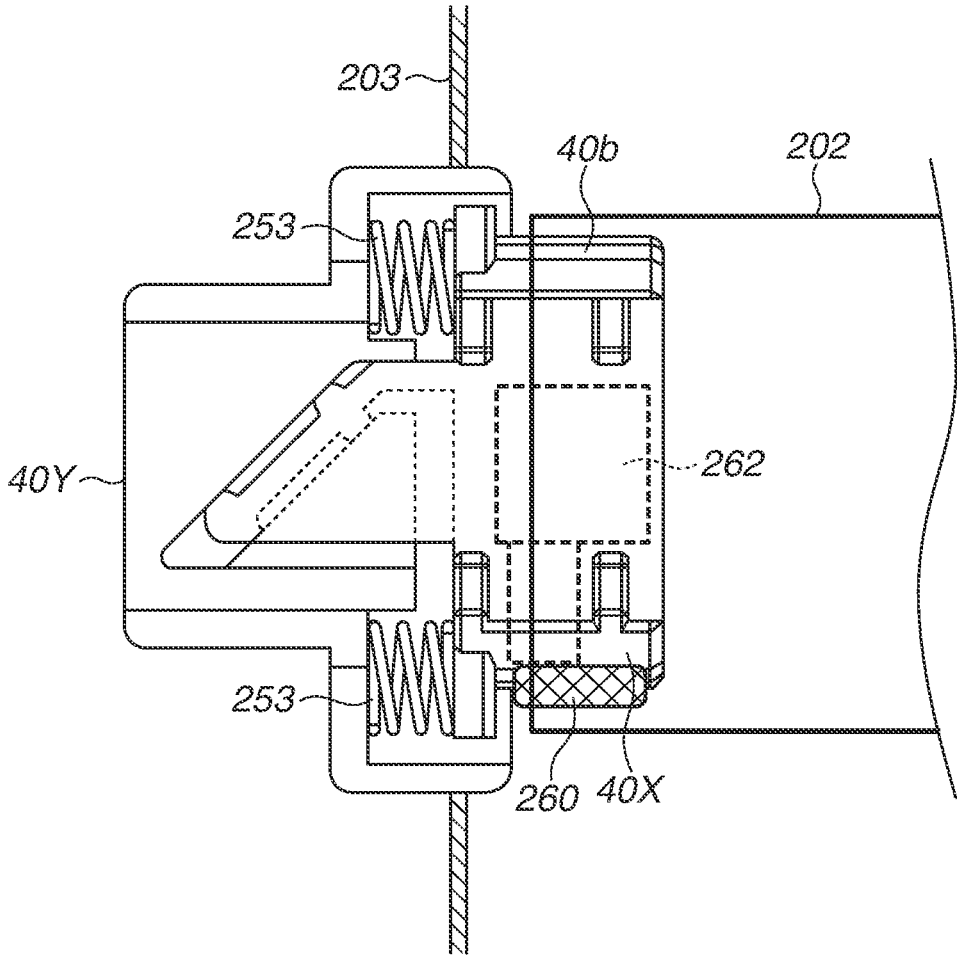
FIG. 7 is a cross-sectional view illustrating a vicinity of the flange in the image heating apparatus according to an example modification of the first example embodiment.

As illustrated in FIG. 7, a lubricant storage container 262, which supplies the lubricant to the lubricant application unit 260, may be provided. The lubricant storage container 262 is provided in the movable member 40X as indicated by a dotted line in FIG. 7, and is provided connectably with the lubricant application member. Configuring the image heating apparatus 200 in this manner allows the lubricant to be stored in advance and supplied from the lubricant storage container 262 to the lubricant application member 260, thereby allowing the lubricant to be further prevented from being depleted.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2018-245426, filed Dec. 27, 2018, which is hereby incorporated by reference herein in its entirety.

What is claimed is:

1. An image heating apparatus configured to allow a recording material having an image formed on the recording material to be heated while being conveyed at a nip portion, thereby allowing the image to be fixed to the recording material, the image heating apparatus comprising:

a film, wherein the film is an endless film;

a pressing member forming the nip portion together with the film by contacting an outer peripheral surface of the film; and a film holding member provided at a longitudinal end portion of the film, wherein the film holding member includes a movable member, wherein the movable member includes a restriction surface configured to restrict a longitudinal movement of the film by contacting the film when the film moves longitudinally and includes a guide surface facing an inner peripheral surface of the film and configured to guide a rotation of the film, wherein, as seen in a direction perpendicular to a surface of the nip portion, the guide surface includes a lubricant application unit configured to apply lubrication to the film from an upstream half of the guide surface located in a direction upstream of a conveyance direction of the recording material, and wherein lubrication is not applied to the film from the remaining half of the guide surface located downstream of the upstream half of the guide surface, and wherein the film holding member further includes a biased member supporting the movable member and including a force reception portion configured to receive a biasing force toward the pressing member, and is configured in such a manner that a movement of the movable member in a longitudinal direction of the film causes the movable member to move upstream in the conveyance direction of the recording material at the nip portion relative to the biased member and causes the lubricant application unit to abut against the film inner peripheral surface.

2. The image heating apparatus according to claim 1, wherein the film holding member is provided with a lubricant storage container configured to supply a lubricant to the lubricant application unit.

3. The image heating apparatus according to claim 2, wherein the lubricant storage container is provided on the movable member.

4. The image heating apparatus according to claim 1, wherein the movable member further includes a protrusion portion protruding longitudinally outward in the film longitudinal direction, and includes a sliding portion provided on the protrusion portion, wherein the sliding portion extends from a downstream side toward an upstream side in a movement direction of the recording material at the nip portion as it extends outward in the film longitudinal direction, wherein the biased member includes a recessed portion to accommodate the protrusion portion, wherein the recessed portion includes an inclined surface that extends from the downstream side toward the upstream side in the movement direction of the recording material at the nip portion as it extends outward in the film longitudinal direction, and wherein, when the restriction surface is biased by the film and the movable member moves in the film longitudinal direction, the sliding portion contacts the inclined surface and the movable member moves upstream in the conveyance direction of the recording material at the nip portion along the inclined surface.

5. The image heating apparatus according to claim 1, further comprising a nip formation member provided in an inner space of the film and configured to form the nip portion together with the pressing member via the film.

6. The image heating apparatus according to claim 5, wherein the nip formation member is a heater.

7. An image heating apparatus to heat an image formed on a recording material while being conveyed at a nip portion, the image heating apparatus comprising:

a film, wherein the film is an endless film;

a nip formation member configured to be in contact with an inner peripheral surface of the film;

a roller contacting an outer surface of the film, wherein the roller forms the nip portion in cooperation with the nip portion formation member via the film; and a restriction unit configured to restrict a movement of the film in a generatrix direction of the film, wherein the restriction unit is provided at a position opposing an end surface of the film in the film generatrix direction and includes a movable member and a holding member that movably holds the movable member, wherein the movable member includes a restriction surface configured to restrict the film movement in the film generatrix direction by contacting the end surface of the film when the film moves in the film generatrix direction and includes a guide surface facing the film inner peripheral surface and configured to guide a rotation of the film, wherein the holding member includes a guide portion configured to guide the movable member so as to move upstream in a conveyance direction of the recording material at the nip portion, wherein, as seen in a direction perpendicular to a surface of the nip portion, the guide surface includes a lubricant application unit configured to apply lubrication to the film from an upstream half of the guide surface located in a direction upstream of the conveyance direction of the recording material, and wherein lubrication is not applied to the film from the remaining half of the guide surface located downstream of the upstream half of the guide surface, wherein, when the film moves in the film generatrix direction and pushes the restriction surface of the movable member, the movable member moves upstream in the conveyance direction of the recording material at the nip portion by a force to push the restriction surface of the movable member by the film, and wherein, by moving the movable member upstream in the conveyance direction of the recording material at the nip portion, the film inner peripheral surface is pushed by the guide surface of the movable member and causes the lubricant application unit to abut against the film inner peripheral surface.

8. The image heating apparatus according to claim 7, wherein the restriction unit is provided with a lubricant storage container configured to supply a lubricant to the lubricant application unit.

9. The image heating apparatus according to claim 8, wherein the lubricant storage container is provided on the movable member.

10. The image heating apparatus according to claim 7, wherein the nip formation member includes a heater.

* * * * *